US007134146B2

(12) United States Patent
Westergaard

(10) Patent No.: US 7,134,146 B2
(45) Date of Patent: Nov. 14, 2006

(54) BOXING GLOVE

(75) Inventor: Kai Christian Westergaard, Sollivein 13 NO-1366, Lysaker (NO)

(73) Assignee: Kai Christian Westergaard, Lysaker (NO)

( * ) Notice: Subject to any disclaimer, the term of this patent is extended or adjusted under 35 U.S.C. 154(b) by 0 days.

(21) Appl. No.: 10/959,308

(22) Filed: Oct. 7, 2004

(65) Prior Publication Data

US 2005/0097649 A1 May 12, 2005

(30) Foreign Application Priority Data

Oct. 8, 2003 (EP) ..... 03022461

(51) Int. Cl.
*A41D 13/08* (2006.01)
*A41D 19/00* (2006.01)

(52) U.S. Cl. ..... 2/18; 2/161.1

(58) Field of Classification Search ..... 2/16, 2/17, 18, 20, 159, 160, 161.1, 161.2, 161.4, 2/162, 170, 910, 917; 602/20, 21, 22, 24; 128/878, 879; 473/458
See application file for complete search history.

(56) References Cited

U.S. PATENT DOCUMENTS 2,117,655 A * 5/1938 Deghenghi ..... 313/274
2,567,489 A * 9/1951 Lewis ..... 2/20
4,445,507 A * 5/1984 Eisenberg ..... 2/16
4,524,464 A * 6/1985 Primiano et al. ..... 2/16
4,565,195 A * 1/1986 Eisenberg ..... 2/16
4,787,376 A * 11/1988 Eisenberg ..... 2/20
4,958,384 A 9/1990 McCrane
5,014,689 A * 5/1991 Meunchen et al. ..... 602/21
5,033,119 A 7/1991 Wiggins
5,146,624 A * 9/1992 Bruckner ..... 2/18
5,513,391 A 5/1996 Garneau et al.
5,538,501 A * 7/1996 Caswell ..... 602/64
5,557,806 A * 9/1996 Caswell et al. ..... 2/161.1
5,682,611 A * 11/1997 Kline ..... 2/160
5,745,916 A * 5/1998 Linner ..... 2/16
5,787,896 A * 8/1998 Sackett ..... 128/880
5,802,614 A * 9/1998 Melone, Jr. ..... 2/161.1
6,093,165 A 7/2000 Estwanik
6,757,915 B1 * 7/2004 Sidlo ..... 2/16
6,790,192 B1 * 9/2004 Robinson ..... 602/21

FOREIGN PATENT DOCUMENTS

WO WO 9909848 3/1999

* cited by examiner

*Primary Examiner*—Gary L. Welch

(57) ABSTRACT

A glove for pugilistic sports is disclosed and includes a wrist compartment (B), a hand compartment (A) and a closing system, in form of a velcro strap (1). The closing system is arranged from the inner side of the thumb joint (2) and the radiocarpal joint (3), and extends substantially diagonal across carpus (4) and the inside of the wrist, and encompassing the wrist.

5 Claims, 3 Drawing Sheets

BOXING GLOVE

TECHNICAL FIELD

The present invention relates to a glove for pugilistic sports, including a wrist compartment, a hand compartment and a closing system, in form of a velcro strap.

BACKGROUND OF THE INVENTION

Until about 25 years ago, attachment to the hand and closing of a glove for pugilistic sports meant that it had to be tied with laces. Since laces may have a rather rough surface, which may result in cuts and abrasions, different covers appeared in the 1970's. During this time, a glove for pugilistic sports with a well functioning thumb-web as well as a very advanced closed cell foam was developed. This glove was had good properties in many aspects, but the lacing was, however, poorly constructed and the cover made it difficult to tighten the laces properly.

At the same time, gloves with an elastic strap replacing the laces altogether, was developed. As these gloves, for pugilistic sports, were less time consuming to put on the hand compared to lace up gloves, they gained some popularity.

Moreover gloves closed by velcro strap were developed. Early models normally had only a small velcro flap, which closed the glove for pugilistic sports, altough several versions became available.

U.S. Pat. No. 5,146,624 to Georg F Bruckner discloses a glove for combative sports. This glove construction was focused and developed for good shock absorption. The closing system for this glove was arranged by a velcro strap around the wrist of the user, however, in an opposite direction compared to the present invention.

GB 2,117,655 discloses a boxing glove which has the finger portion and the thumb portion joined by a leather strip. This construction aims at the consequent restriction of movement of the thumb to reduce the likelihood of injury to the users thumb and the likelihood of injury to his opponent's eyes.

WO 99/09848 discloses a glove that supports and stabilises the wrist and hand during sports. This glove comprises an inner and an outer glove, where said outer glove has a wrist strap attached to the thumb side of the outer glove. The wrist strap extends diagonally across the back of the hand to accomplish the object of support and stabilisation.

U.S. Pat. No. 5,745,916 discloses a glove for ice hockey and similar sports, which has a closing system consisting of a velcro strap on the inside of the wrist.

U.S. Pat. No. 5,682,611 discloses a thumbguard with a dynamisation strap, which assists in resisting abduction of the basal joint. However, U.S. Pat. No. 5,682,611 does not disclose a closing system for a glove.

A glove intended to be used in combative sports are most of the time divided into two parts; the cuff around the wrist and the hand compartment. These two parts of the glove is usually segmented. This means that closing systems, such as velcro straps, which only tighten the cuff, will not offer any wrist support or possibility to adjust the hand compartment. Also, since the closing systems, such as velcro straps, end at the outside of the hand, there is also a risk of cuts and abrasions.

A lace-up glove, which is properly constructed, will have lacing extending from the wrist to the palm of the hand. Such lace holes in the palm of the glove will allow the user to pull in the thumb. However, full assistance is required from another person who laces the glove. Moreover, the procedure is time consuming. It is possible to get some wrist support from a lace-up glove as the lacing extends through both parts of the glove, but only if the glove is properly tightened, which is very time consuming. The lace-up gloves are the only gloves that may, if they are tied properly, give some support and stability to the thumb and wrist.

SUMMARY OF THE INVENTION

It is an object of the present invention to provide a glove for pugilistic sports, that is easy and fast to put on and take off, which glove provides wrist support by a closing system that extends through both the cuff and the hand compartment of said glove.

It is another object of the present invention to provide a glove for pugilistic sports, that is easy and fast to put on and take off.

It is a further object of the invention to provide a glove that has a closing system that gives stability and support to the thumb.

It is yet another object of the present invention to provide a glove that includes a closing system that provides adjustability to the hand compartment.

It is further yet another object of the present invention to provide a glove for pugilistic sports, that minimises the risk of cuts and abrasions on the opponent.

To achieve these objects the glove for pugilistic sports according to the invention has the characteristic features according to claim 1.

BRIEF DESCRIPTION OF THE DRAWINGS

Further objects, features and advantages of the invention will become apparent from the attached description of several embodiments of the invention taken in conjunction with the appended drawings, which.

DETAILED DESCRIPTION OF THE INVENTION

The invention provides a glove for pugilistic sports, which has a closing system, in form of a velcro strap 1, arranged from an inner side of a thumb joint 2 and a radiocarpal joint 3, and extends substantially diagonal across carpus 4 and the inside of the wrist, and encompassing the wrist.

The use of a velcro strap rather than laces in the closing system of the present invention, because it is much faster and easier. Thus, in contrast to the gloves in the prior art, which use laces in the closing system, the glove according to the invention is very easy and fast to put on and take off and requires no assistant.

The closing system according to the invention provides wrist support. The velcro strap 1 is attached from the inner side of the thumb joint 2 to the radiocarpal joint 3 and thus extends through the wrist compartment to the hand compartment. When the closing system, in form of the velcro strap, then is wrapped around the wrist of the user, the wrist compartment and the hand compartment are tied together, which gives stability and support to the users hand and wrist.

Figure 1:
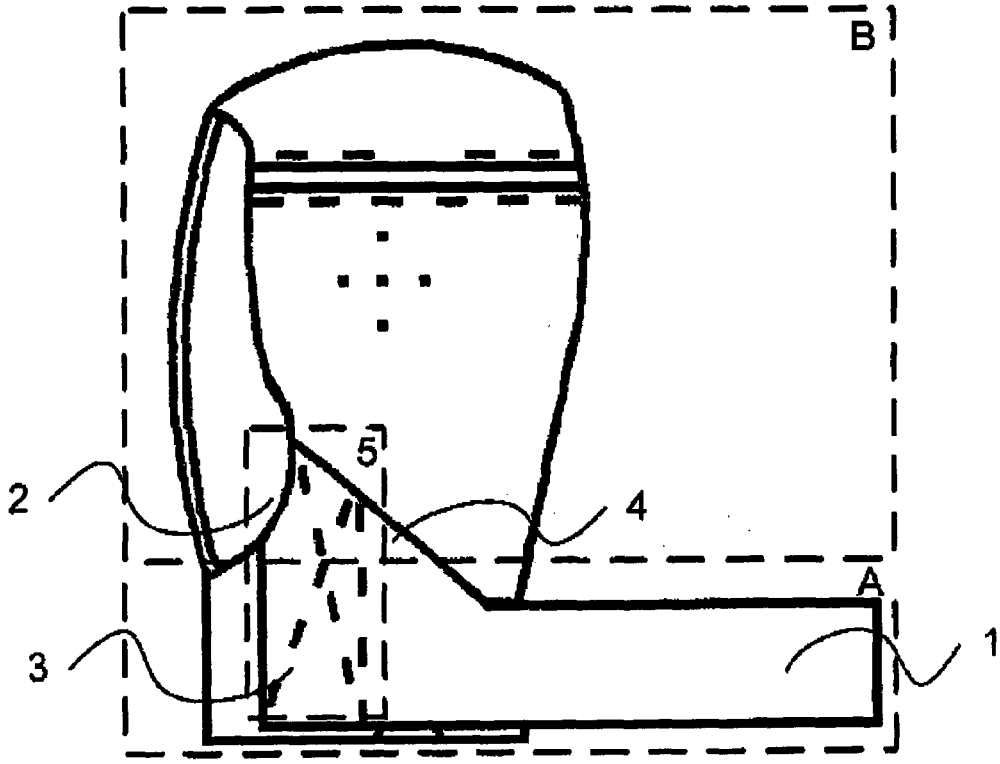
FIG. 1 is a plan view of the underside of the glove according to the invention, with the closing system in an open position.

The attachment of the velcro strap 1 extends longitudinally from the inner side of the thumb joint 2 to the radiocarpal joint 3, and thus from the hand compartment A to the wrist compartment B. The attachment point, from the thumb joint 2 to the radiocarpal joint 3, may be strengthened by an arrangement of seems 5. The arrangement of seems 5 may be any arrangement that lends extra stability and support to the connection of the hand compartment A and the wrist compartment B. In FIG. 1 there is disclosed three seems, two of which cross each other and the third extending substantially longitudinally.

The closing system according to the invention is directed from the inner side of the thumb across carpus 4 and the inside of the wrist, which is the opposite direction compared to the gloves in the prior art, for example the glove in U.S. Pat. No. 5,146,624. The result is that the free end of the velcro strap 6 ends up pointing in the direction of the thumb at the outside of the wrist, in contrast to the velcro strap in U.S. Pat. No. 5,146,624, which end up pointing in the opposite direction. When the end of the velcro strap 6 is pointing in the direction of the present invention, the risk of cuts and abrasions, from the velcro strap 1, is minimised.

Figure 3:
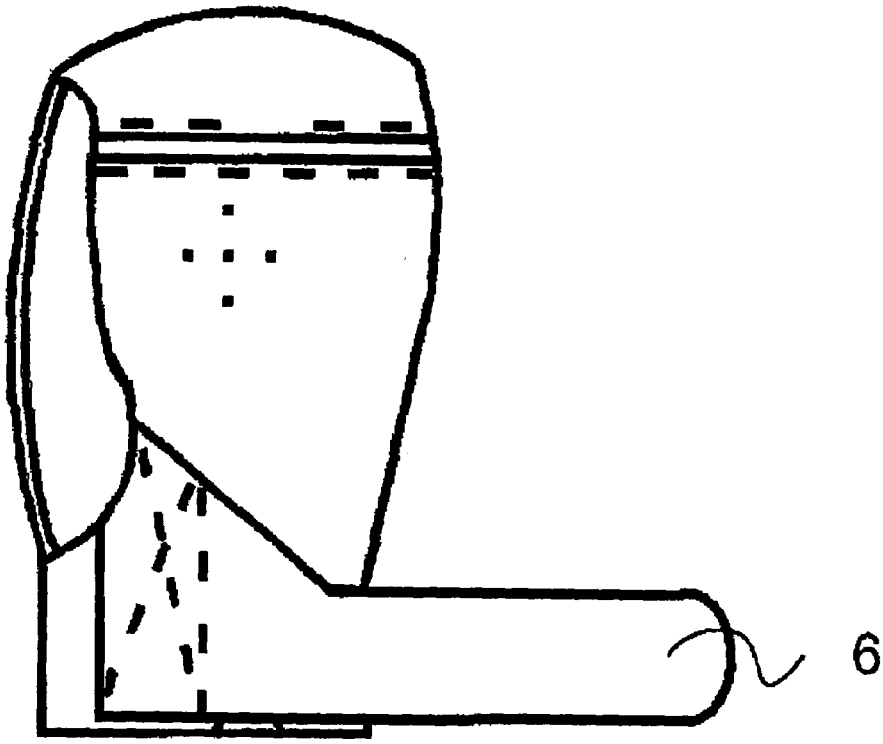
FIG. 3 is a plan view of the underside of the glove according to the invention, with the closing system in an open position.

In a second embodiment of the present invention, shown in FIG. 3, the end of the velcro strap 6 has a substantially rounded design, to further minimise the risk of cuts and abrasions.

The closing system according to the invention provides stability and support to the thumb. The velcro strap 1 is, as mentioned earlier, attached from the inner side of the thumb joint 2 to the radiocarpal joint 3, and thus extends through the wrist compartment A to the hand compartment B. When the closing system, in form of the velcro strap 1, then is wrapped around the wrist of the user, the thumb is pulled down towards the centre of the hand. This results in a decreased risk in bending the thumb backwards, thus spraining or breaking it. The risk of injury to the eyes of the opponent, with an out sticking thumb, is also decreased by pulling the thumb down towards the centre of the hand. Also, when the closing system, in form of the velcro strap 1, is wrapped around the wrist of the user, it adjusts the hand compartment to the size of the users hand.

Figure 2:
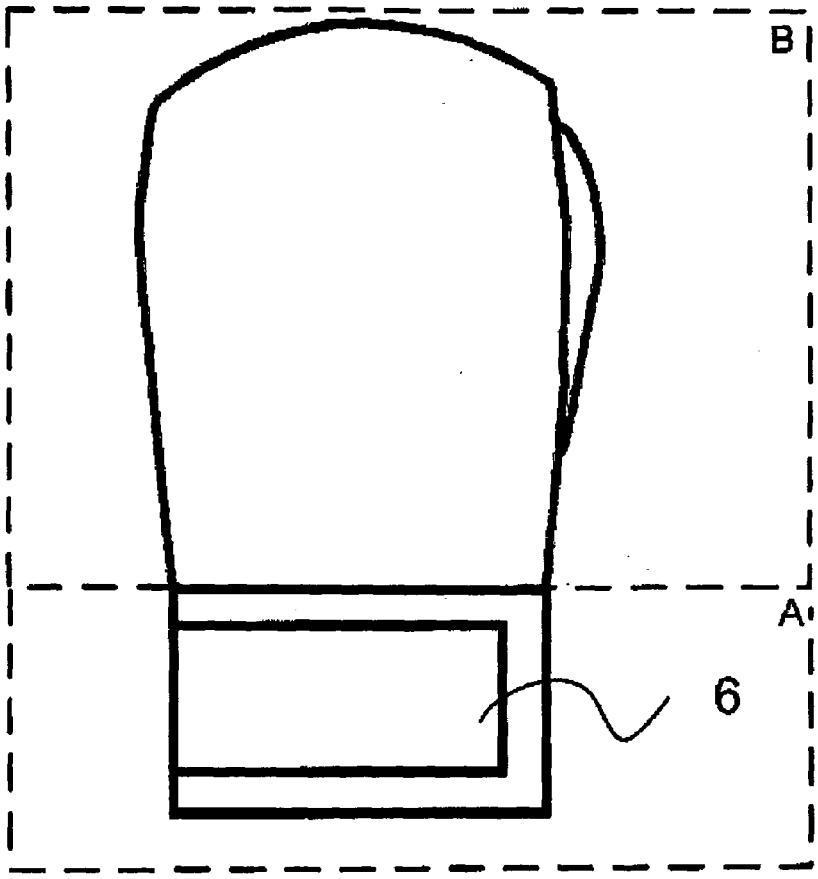
FIG. 2 is a plan view of the top side of the glove according to the invention, with the closing system in a closed position.

In the first embodiment of the present invention, shown in FIG. 2, the closing system is arranged in such way that said first end has a longitudinal extension larger than the longitudinal dimension of said wrist compartment A and from said first end has a portion 6 of reduced longitudinal extension, followed by a portion 7 having constant longitudinal extension. This portion of constant longitudinal extension preferably begins at the end of the inside of the wrist compartment B.

The closing system of the present invention may encompass more than 360 degrees, preferably between 90 and 300, more preferably between 180 and 270, such as 190, 200, 210, 220, 230, 240, 250, and 260 degrees.

The invention has been described above with reference to an exemplary glove. Modifications appearing to a skilled person reading the present specification are intended to be within the scope of the invention which is merely limited by the appended patent claims.

The invention claimed is:

1. A glove for pugilistic sports, comprising:

a wrist compartment, a hand compartment, and a closing system, in form of a velcro hook and loop fastener strap, wherein said closing system extends from the inner side of the wrist compartment and the inner side of the hand compartment, and substantially diagonal across carpus and the inside of the wrist, and encompassing the wrist, whereby the thumb joint and the radiocarpal joint of a user is stabilized and the thumb is pulled down towards the center of the hand of a user during use.

2. The glove according to claim 1, wherein said closing system has a first end attached to said wrist compartment and hand compartment of an underside of said glove adjacent said inner side of the thumb joint and the radiocarpal joint, and a second end which in use is attached to the top side of said wrist compartment.

3. The glove according to claim 2, wherein said first end has a longitudinal extension larger than the longitudinal dimension of said wrist compartment and from said first end has a portion of reduced longitudinal extension, followed by a portion having constant longitudinal extension.

4. The glove according to claim 1, wherein the extension from the thumb joint to the radiocarpal joint is provided with an arrangement of seems.

5. The glove according to claim 1, wherein the end of the velcro hook and loop fastener strap has a substantially rounded design.

* * * * *